US005799735A

United States Patent [19]

Sundholm

[11] Patent Number: 5,799,735

[45] Date of Patent: Sep. 1, 1998

[54] FIRE FIGHTING SYSTEM FOR DISCHARGING A LIQUID-GAS FINELY DIVIDED MIST

[76] Inventor: Göran Sundholm, Ilmari Kiannon kuja 3, Fin-04310 Tuusula, Finland

[21] Appl. No.: 716,165

[22] PCT Filed: Apr. 13, 1995

[86] PCT No.: PCT/FI95/00216

§ 371 Date: Sep. 18, 1996

§ 102(e) Date: Sep. 18, 1996

[87] PCT Pub. No.: WO95/28205

PCT Pub. Date: Oct. 26, 1995

[30] Foreign Application Priority Data

Apr. 14, 1994 [FI] Finland ..... 941738
Apr. 28, 1994 [FI] Finland ..... 941975

[51] Int. Cl.[6] ..... A62C 35/68

[52] U.S. Cl. ..... 169/9; 169/13; 169/14; 169/15

[58] Field of Search ..... 169/5, 9, 13, 14, 169/15

[56] References Cited

U.S. PATENT DOCUMENTS

| | | | |
|---|---|---|---|
| 4,390,069 | 6/1983 | Rose, Jr. | 169/15 |
| 4,981,178 | 1/1991 | Bundy | 169/9 |
| 5,113,945 | 5/1992 | Cable | 169/15 |
| 5,255,747 | 10/1993 | Teske et al. | 169/15 |

FOREIGN PATENT DOCUMENTS

94/07570 4/1994 WIPO .

OTHER PUBLICATIONS

Derwent's abstract, No. 86–330389/50, week 8650, Abstract of SU, 787048 (Fire Fighting Eng C), 15 Dec. 1980.

Derwent's abstract, No. 88–166804/24, week 8824, Abstract of SU, 1353444 (Bogomolov AA) 23 Nov. 1987.

*Primary Examiner*—Andrew C. Pike
*Attorney, Agent, or Firm*—Ladas & Parry

[57] ABSTRACT

A fire fighting system has a liquid source, a pump connected to the liquid source having an outlet line with spray heads for providing a high liquid pressure and a comparatively small flow, and a gas source of propellant gas connected by way of a line to the outlet line for mixing gas with the liquid into a flow of an extinguishing fluid delivered to the spray heads. The gas source is connected to the outlet line of the pump for producing a finely divided liquid mist, an initial charge pressure of the gas source being at least as high as the high liquid pressure provided by the pump. At least one liquid tank is between the gas source and the outlet line. Liquid from the liquid tank is arranged to be driven out into the outlet line by the propellant gas from the gas source, an initial charge pressure of the gas source and a volume of the liquid tank being adapted to one another so that when the liquid tank has been emptied of the liquid a pressure of the gas source is at least substantially the same as the high liquid pressure of the pump.

14 Claims, 2 Drawing Sheets

FIRE FIGHTING SYSTEM FOR DISCHARGING A LIQUID-GAS FINELY DIVIDED MIST

The present invention relates to a fire fighting installation, i.e., system comprising a liquid source, a pump connected to said liquid source and preferably having a high liquid pressure and comparatively small flow, and a gas source connected by way of a line to an outlet line of the pump for mixing gas with outbound extinguishing liquid delivered to spray heads.

Certain kinds of gasoline fires, for example a kerosene fire in an aircraft jet engine undergoing an engine test in a hangar designed for that purpose, are nearly impossible to extinguish even by means of strong mist-like jets of liquid, as suggested for example in international patent application PCT/FI92/00155 which was published as WO 092/20454. Such a jet engine fire will only go out when the entire hangar, which may typically have a volume of about 3000 cc, has been subjected to "total flooding", i.e., is in practice entirely filled with liquid mist having very small particles.

The liquid mist can in principle be produced with apparatus as described in international patent application PCT/FI92/00317which was published as WO 93/10859. In that application, an outgoing ascension tube of a hydraulic accumulator is provided with wall apertures, so that the propellent gas of the accumulator initially drives out liquid only, and after the liquid level has sunk to be even with the uppermost tube wall aperture, mixing of propellent gas into the outbound liquid is gradually started as the liquid level sinks and more tube wall apertures are exposed. In the final stage of emptying the accumulator, it is possible to obtain a liquid mist having sufficiently small droplets for the present purpose, but too large a portion of the liquid contained in the hydraulic accumulator will go waste.

It is an object of the present invention to provide a novel installation enabling effective delivery of liquid with immediate effective mixing of gas into the liquid right from the start. The installation of the invention is primarily characterized in that the gas source is connected to the outlet line of the pump for producing a finely divided liquid mist. The purpose of the gas is to enable fine division of the liquid droplets, which produces a finely divided liquid mist. When the pressure in the line leading to the nozzles is increased, the liquid mist becomes even more finely divided. Preferably, the gas source is arranged to mix gas in the outlet line of the pump with at least substantially the same high pressure as the pump.

The gas source can advantageously be constituted by a plurality of compressed-gas bottles coupled in parallel. The gas may be nitrogen, argon, air, etc. In principle, any suitable gas may be used. The contents of the compressed-gas bottles may be partially in liquid form, depending on the type of gas employed. The charge pressure of the gas bottles, like the operating pressure of the pump, may be approximately 50–200 bar, even though both lower and higher pressures are possible.

A comparatively small pump flow in this context means that the flow is smaller than the flow capacity of the relevant sprinklers or spray heads at maximum operating pressure. The pump flow may be 10–80%, preferably 20–50% of the total flow of extinguishing fluid at maximum operating pressure.

Thus, one can cope with a small pump that is inexpensive and requires little electric power.

In so-called pure oil fires, it is often expedient to mix a foam concentrate with the extinguishing liquid to produce a fire-smothering foam that prevents re-ignition. The hitherto known installations for this purpose have usually been ineffective, as the fire smoke will spoil the foam, that is, prevent the foam concentrate from developing into a foam.

The installation in accordance with the present invention enables effective foam formation on account of the comparatively large amount of pure gas, e.g., nitrogen gas, injected concurrently, which will shield the fire smoke from direct contact with the injected foam concentrate.

In a fire for example on the car deck of a car ferry, also other material than oil, such as wood, cardboard, etc., will burn. To be able to overcome also such fires, in a preferred embodiment of the invention the gas source, preferably a plurality of gas bottles, is arranged at a first stage to empty one or more liquid tanks in order to at least suppress the fire, the gas pressure being so adapted that when the liquid tanks are empty, the gas pressure is at least substantially as high as the operating pressure of the pump.

In the following the invention will be described with reference to the accompanying drawing showing two preferred embodiments of the installation in accordance with the invention.

Figure 1:
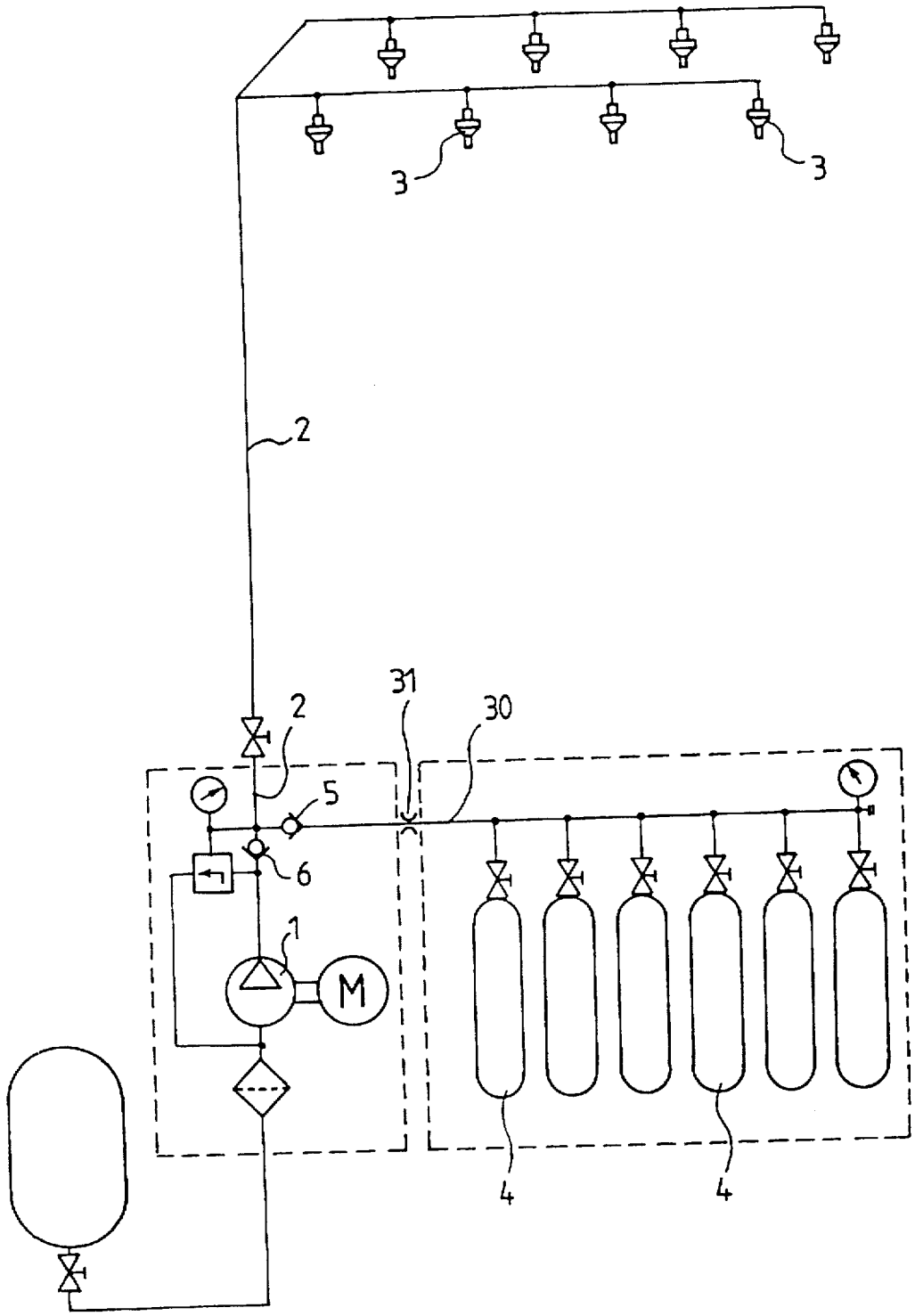
FIG. 1 shows an embodiment for immediate production of finely divided liquid mist.

The embodiment shown in FIG. 1 comprises a pump 1, for a liquid. The pump has an outlet line 2 leading to a plurality of spray heads 3. The pump 1 may be a high-pressure pump with a typical operating pressure of 50–200 bar. A plurality of compressed-gas bottles 4 coupled in parallel are connected to the outlet line 2 of the pump via a check valve 5 for ensuring that none of the liquid will enter the compressed-gas bottles 4 and a throttle 31 in a line 30. A check valve 6 mounted in the outlet line 2 of the pump ensures likewise that the gas will be correctly routed, i.e., not into the pump but into the outlet line. The compressed-air bottles 4 can be filled with nitrogen. The pressure of the gas in the compressed-gas bottles can suitably be 100–300 bar.

There purpose of the throttle 31 in the line 30 between the compressed-gas bottles and the outlet line 2 of the pump, is to enable adjustment of the mixing ratio of the liquid and gas in the extinguishing fluid flowing that forms the outlet line 2 to the spray heads 3 and from the spray heads as the desired finely divided mist. However, the throttle 31 is optional. The mixing ratio could be adjusted by variously dimensioning the line 30.

Figure 2:
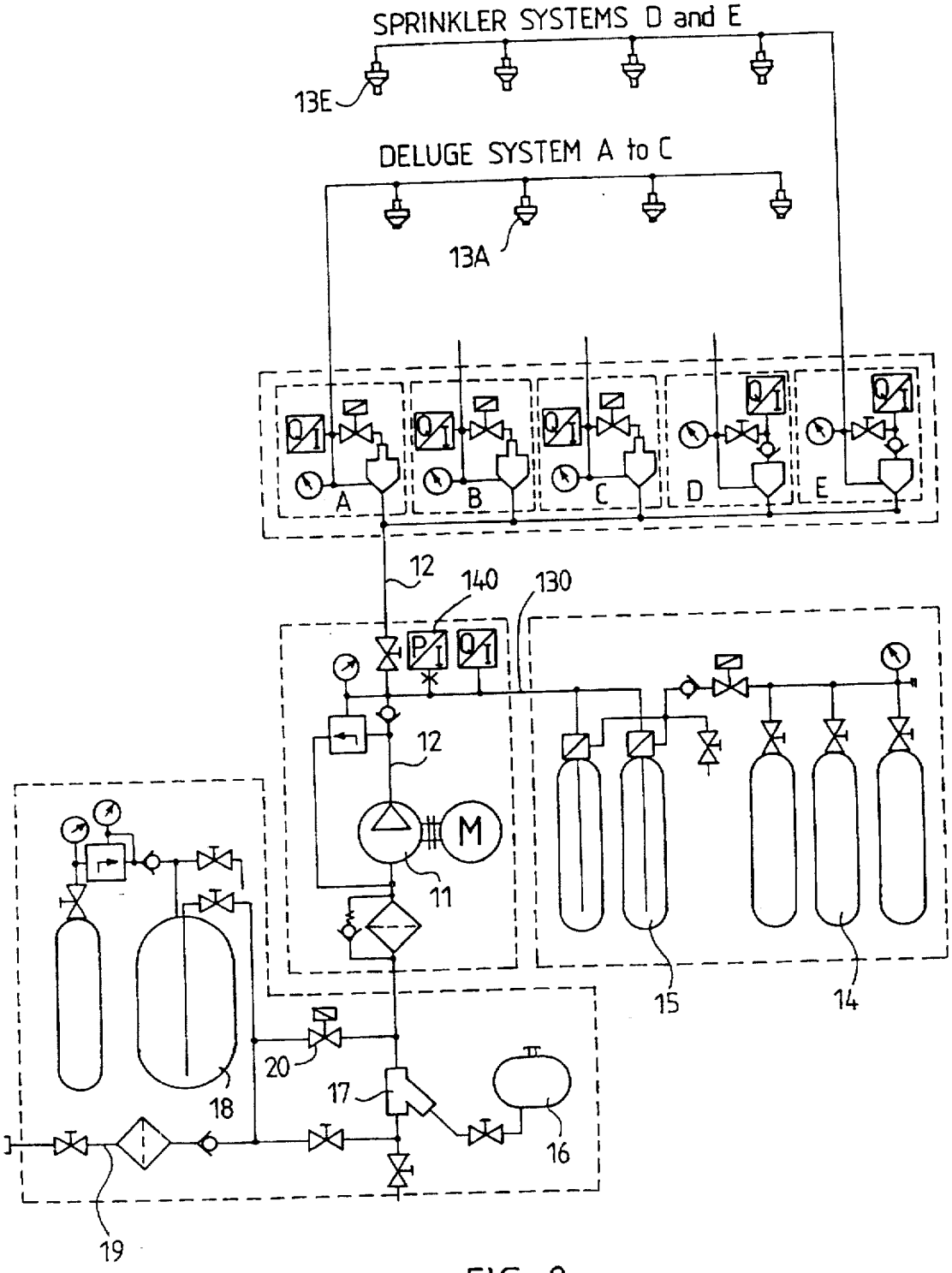
FIG. 2 shows an embodiment for initial spraying of liquid and subsequent production of finely divided liquid mist and foam.

In FIG. 2, reference numeral 11 denotes a pump aggregate that can comprise for example two 11 kW pumps each having a flow of approximately 50 l/min. and a pressure of approximately 120 bar. An outlet line 12 leads to a plurality of fire zones A–E having respective spray heads or sprinklers 13A, 13E (only two shown). A plurality of compressed-gas bottles 14 and a plurality of liquid tanks 15, with a total of for example 400 liters, are provided for each pump. The compressed gas at an initial pressure of 200 bar, for instance, first forcibly drives out the liquid from the tanks 15 to the respective activated fire zone with a flow of for example 1000 l/min., whereafter the operation is in principle similar as in FIG. 1. After the bottles have been emptied of liquid, the pressure in the compressed-gas bottles 14 has decreased to 120 bar, that is, to the pressure of the pump 11. Thereafter the pressure of the pump 11 adjusts itself in accordance with the pressure of the compressed-gas bottles 14, so that the pump flow is 20–100% of the declining total flow of extinguishing fluid. When there is no gas in the compressed-gas bottles 14 and the gas pressure has decreased to zero, the pump flow is 100% of the total flow of extinguishing fluid.

A container for foam concentrate is denoted at 16 and a foam-mixing device at 17. A freshwater tank, for example 3000 liters, is denoted at 18 and a seawater or lake-water connection is denoted at 19.

In the first stage, when the tanks 15 are being emptied of liquid, the effect/action of the pump aggregate 11 is negligible. Valve 20 must be open during said first stage so that no water will enter the foam-mixing device 17 in order to keep said device out of operation, since mixing of foam into the extinguishing fluid must be avoided at the beginning of the extinguishing operation. This is because the foam has the effect of making the droplets issuing from the nozzles larger, which will prevent the development of finely divided liquid mist. At the beginning of the extinguishing operation, finely divided liquid mist is specifically wanted. Thus foam will not serve well at the beginning of the extinguishing operation.

After the tanks 15 are emptied, effective production of finely divided liquid mist can be upheld with the exemplary values given above for about half an hour by using the freshwater tank 18, whereafter seawater or lake-water can be used if necessary.

After the fire has been suppressed with water mist, valve 20 can advantageously be shut to supply foam into the extinguishing fluid to produce a thick "foam matting" that will prevent re-ignition. It is to be noted that the installation in accordance with FIG. 2 need not comprise a foam-mixing device at all. In practice, valve 20 is shut in such a way that a pressure switch 140 coupled in line 130 is adapted to give a pressure signal after the pressure has decreased under a predetermined level, for example 30 bar. This pressure signal thus controls valve 20.

The gas bottles 14 can naturally be alternatively connected to the outlet line 12 to by-pass the liquid tanks 15.

The invention has been described in the above by way of examples, and therefore it should be noted that the invention may vary in its details in many ways within the scope of the appended claims. Thus for example the execution of the compressed-gas source may vary. The gas source need not necessarily be constituted by compressed-gas bottles.

I claim:

1. A fire fighting system comprising:

a liquid source (18) of a liquid;

an outlet line (12) with spray heads (13A, 13E);

a pump (11) connected to said liquid source for providing the liquid a high liquid pressure and a comparatively small flow;

a gas source (14) of propellant gas connected by way of a line (130) to the outlet line (12) for mixing the propellant gas with the liquid of the pump into a flow of an extinguishing fluid delivered through the outlet line (12) to the spray heads (13A, 13E) for producing a finely divided liquid mist, an initial charge pressure of the gas source (14) being at least as high as the high liquid pressure provided by the pump (11) ; and at least one liquid tank (15) of the liquid between the gas source (14) and the outlet line (12) , the liquid from the liquid tank being arranged to be driven out into the outlet line (12) by the propellant gas from the gas source, the initial charge pressure of the gas source and a volume of the liquid tank (15) being adapted to one another so that when the liquid tank (15) has been emptied of the liquid a pressure of the gas source (14) is at least substantially the same as the high liquid pressure of the pump (11).

2. The system as claimed in claim 1, wherein the gas source (14) is adapted to mix the propellant gas in the outlet line (12) with at least substantially the same high liquid pressure as provided by the pump (11).

3. The system as claimed in claim 2, wherein the initial charge pressure of the gas source (14) is 100 to 300 bar and the comparatively small flow of the pump (11) is approximately 10–80% of the flow of the extinguishing fluid at a maximum operating pressure.

4. The system as claimed in claim 1, wherein the gas source comprises a plurality of compressed-gas bottles (14) coupled in parallel.

5. The system as claimed in claim 1, wherein the initial charge pressure of the gas source (14) is 100 to 300 bar and the comparatively small flow of the pump (11) is approximately 10–80% of the flow of the extinguishing fluid at a maximum operating pressure.

6. The system as claimed in claim 1, further comprising a foam-mixing unit having a foam-mixing source (16) of a foam and a foam-mixing apparatus (17), and a pressure switch (140) coupled in the line (130) of the gas source , the pressure switch giving a pressure signal after pressure in the line (130) of the gas source has decreased to a predetermined level and the pressure signal controlling a valve (20) to effect mixing of the foam into the extinguishing fluid with the foam-mixing unit.

7. The system as claimed in claim 6, wherein the pressure switch (140) shuts the valve (20) at the predetermined level , the valve preventing the mixing of the foam with the extinguishing fluid while being open.

8. In a system for fighting a fire having a source of a liquid, an outlet line, pump means connected to the outlet line for providing a flow of the liquid at a liquid pressure to the outlet line, and spray head means connected to the outlet line for spraying an extinguishing fluid, whereby to fight the fire, the improvement comprising;

gas means having a connection to the outlet line between the pump and the spray head means for mixing a flow of a gas at a gas pressure with the flow of the liquid to form a flow of the extinguishing fluid, wherein the combination of the liquid, the flow of the liquid, the liquid pressure, the gas, the flow of the gas, the gas pressure, the flow of the extinguishing fluid, and the spray head means is such that the extinguishing fluid is sprayed from the spray head means as a finely divided mist, and wherein the gas means comprises:

a source of the gas at the gas pressure; and liquid tank means, having at least one tank of the liquid and the connection of the gas means to the outlet line, being connected to the source of the gas for the gas pressure first to drive the liquid from the at least one tank through the connection into the outlet line and then provide the flow of the gas.

9. In a system for fighting a fire having a source of a liquid, an outlet line, pump means connected to the outlet line for providing a flow of the liquid at a liquid pressure to the outlet line, and spray head means connected to the outlet line for spraying an extinguishing fluid, whereby to fight the fire, the improvement comprising;

gas means having a connection to the outlet line between the pump and the spray head means for mixing a flow of a gas at a gas pressure with the flow of the liquid to form a flow of the extinguishing fluid, wherein the combination of the liquid, the flow of the liquid, the liquid pressure, the gas, the flow of the gas, the gas pressure, the flow of the extinguishing fluid, and the spray head means is such that the extinguishing fluid is sprayed from the spray head means as a finely divided mist, wherein the gas means comprise compressed-gas bottles connected in parallel for providing an initial pressure and then lower pressures for the gas pressure, and wherein the gas means further comprise:

liquid tank means, having at least one tank of the liquid and the connection to the outlet line, being connected to the compressed-gas bottles for the gas pressure first to drive the liquid from the at least one tank through the connection into the outlet line and then provide the flow of the gas.

10. The system according to claim 9, wherein the initial pressure is 100 to 300 bar and the flow of the liquid of the pump means is approximately 10% to 80% of the flow of the extinguishing fluid when the gas pressure is the initial pressure.

11. The system according to claim 9, and further comprising:

foam means for providing a foaming material to the liquid after a predetermined one of the lower pressures.

12. In a system for fighting a fire having a source of a liquid, an outlet line, pump means connected to the outlet line for providing a flow of the liquid at a liquid pressure to the outlet line, and spray head means connected to the outlet line for spraying an extinguishing fluid, whereby to fight the fire, the improvement comprising;

gas means having a connection to the outlet line between the pump and the spray head means for mixing a flow of a gas at a gas pressure with the flow of the liquid to form a flow of the extinguishing fluid, wherein the combination of the liquid, the flow of the liquid, the liquid pressure, the gas, the flow of the gas, the gas pressure, the flow of the extinguishing fluid, and the spray head means is such that the extinguishing fluid is sprayed from the spray head means as a finely divided mist, wherein the liquid pressure is from 50 to 200 bar, wherein the liquid and gas pressures are substantially the same, wherein the gas means comprise compressed-gas bottles connected in parallel for providing an initial pressure and then lower pressures for gas pressure, and wherein the gas means further comprise:

liquid tank means, having at least one tank of the liquid and the connection to the outlet line, being connected to the compressed-gas bottles for the gas pressure first to drive the liquid from the at least one tank through the connection into the outlet line and then provide the flow of the gas.

13. The system according to claim 12, wherein the initial pressure is 100 to 300 bar and the flow of the liquid of the pump means is approximately 10% to 80%of the flow of the extinguishing fluid when the gas pressure is the initial pressure.

14. The system according to claim 12 and further comprising:

foam means for providing a foaming material to the liquid after a predetermined one of the lower pressures.

* * * * *